US007040559B2

(12) United States Patent
Matlin et al.

(10) Patent No.: US 7,040,559 B2
(45) Date of Patent: May 9, 2006

(54) SHREDDER WITH LOCK FOR ON/OFF SWITCH

(75) Inventors: Taihoon K. Matlin, Round Lake Beach, IL (US); David G. Hartnett, Carol Stream, IL (US)

(73) Assignee: Fellowes Inc., Itasca, IL (US)

( * ) Notice: Subject to any disclaimer, the term of this patent is extended or adjusted under 35 U.S.C. 154(b) by 110 days.

(21) Appl. No.: 10/815,761

(22) Filed: Apr. 2, 2004

(65) Prior Publication Data

US 2005/0218250 A1 Oct. 6, 2005

(51) Int. Cl.
*B02C 25/00* (2006.01)

(52) U.S. Cl. ..... 241/36; 241/37.5; 241/100; 241/101.3

(58) Field of Classification Search ..... 241/36, 241/37.5, 100, 101.3
See application file for complete search history.

(56) References Cited

U.S. PATENT DOCUMENTS

| | | | | |
|---|---|---|---|---|
| 2,686,466 | A | 8/1954 | Lee | |
| 3,724,766 | A | 4/1973 | Bosland | |
| 4,124,169 | A | 11/1978 | Hatanaka | |
| 4,192,467 | A | 3/1980 | Hatanaka | |
| 4,817,877 | A | 4/1989 | Itoh et al. | |
| 4,821,967 | A | 4/1989 | Moriyama | |
| 4,842,205 | A | 6/1989 | Araki et al. | |
| 4,957,243 | A | 9/1990 | Kanagaki et al. | |
| 5,035,366 | A | 7/1991 | Hashimoto et al. | |
| 5,044,270 | A | 9/1991 | Schwelling | |
| 6,055,394 | A | 4/2000 | Suda et al. | |
| 6,116,528 | A | 9/2000 | Schwelling | |
| 6,274,828 | B1 * | 8/2001 | Chu | 200/43.17 |
| 6,595,444 | B1 | 7/2003 | Schwelling | |

FOREIGN PATENT DOCUMENTS

| | | |
|---|---|---|
| DE | 86 19 856 | 9/1988 |
| DE | 90 14 543 | 1/1991 |
| EP | 1 195 202 | 4/2002 |

* cited by examiner

*Primary Examiner*—Mark Rosenbaum
(74) *Attorney, Agent, or Firm*—Pillsbury Winthrop Shaw Pittman, LLP

(57) ABSTRACT

The present application discloses a shredder with a switch lock that locks the on/off switch in its on/off position.

37 Claims, 14 Drawing Sheets

SHREDDER WITH LOCK FOR ON/OFF SWITCH

FIELD OF THE INVENTION

The present invention relates to shredders for destroying articles, such as documents, CDs, floppy disks, etc.

BACKGROUND OF THE INVENTION

Shredders are well known devices used for shredding items, such as documents, CDs, floppy disks, etc. With identity theft, there has been an increased consumer awareness of the desirability of shredding documents containing sensitive personal information, such as credit card bills, tax documents bearing a person's Social Security number etc.

Shredders contain a series of cutting elements for shredding articles fed therein. Generally, it is desirable to prevent the inadvertent actuation of the motor driving the cutter elements. To this end, the present invention endeavors to provide a construction that has a reduced chance of being inadvertently actuated.

SUMMARY OF THE INVENTION

One aspect of the present invention provides a shredder with a switch lock that locks the on/off switch in its off position. Specifically, the shredder comprises a shredder mechanism including an electrically powered motor and cutter elements. The shredder mechanism enables articles to be shredded to be fed into the cutter elements. The motor is operable to drive the cutter elements so that the cutter elements shred the articles therein. The on/off switch is electrically coupled to the motor of the shredder mechanism. The switch includes a manually engageable portion manually movable by a user's hand between at least (a) an on position wherein the switch enables delivery of electric power to the motor, and (b) an off position disabling the delivery of electric power to the motor. The switch lock is movable between (a) a locking position wherein the switch is locked in the off position, and (b) a releasing position wherein the switch is released for movement from the off position.

Other objects, features, and advantages will become appreciated from the following detailed description, the accompanying drawings, and the appended claims.

DETAILED DESCRIPTION OF THE ILLUSTRATED EMBODIMENT(S) OF THE INVENTION

FIGS. 1–6 illustrate an embodiment of a shredder constructed in accordance with one embodiment of the present invention. The shredder is generally indicated at 10. The shredder 10 sits atop a waste container, generally indicated at 12. The shredder 10 illustrated is designed specifically for use with the container 12, as the shredder housing 14 sits on the upper periphery of the waste container 12 is a nested relation. However, the shredder 10 may be of the type provided with an adaptable mount for attachment to a wide variety of containers. Generally speaking, the shredder 10 may have any suitable construction or configuration and the illustrated embodiment is not intended to be limiting in any way.

Figure 13:
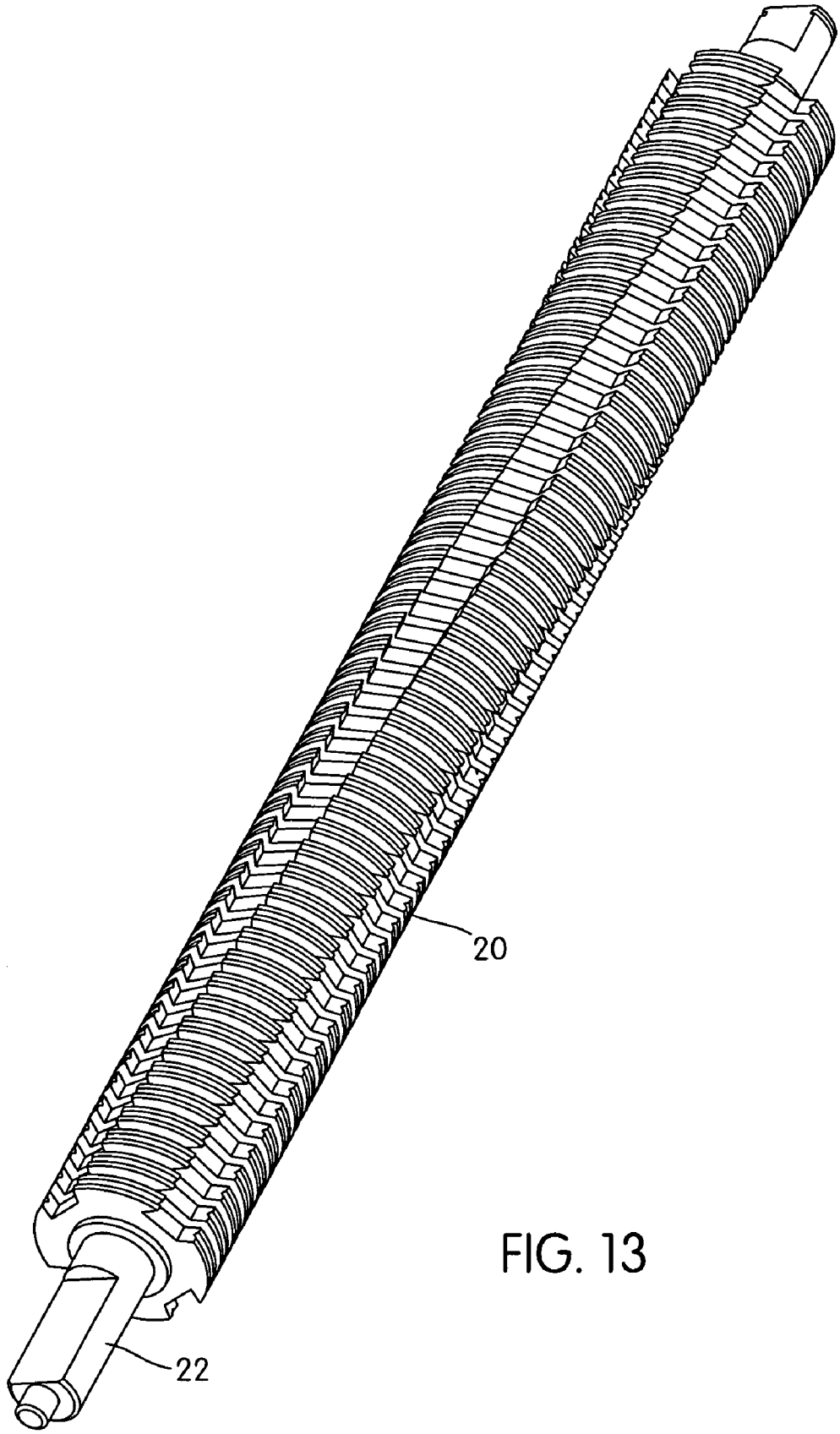
FIG. 13 is a perspective view of a shaft with a plurality of cutter elements.

The shredder 10 includes a shredder mechanism 16 including an electrically powered motor 18 and a plurality of cutter elements 20. The cutter elements 20 are mounted on a pair of parallel rotating shafts 22 in any suitable manner, and an example of a shaft 22 with cutter elements 20 is illustrated in FIG. 13. The motor 18 operates using electrical power to rotatably drive the shafts 22 and the cutter elements 20 through a conventional transmission 23 so that the cutter elements 20 shred articles fed therein. The shredder mechanism 16 also may include a sub-frame 21 for mounting the shafts 22, the motor 18, and the transmission 23. The operation and construction of such a shredder mechanism 16 are well known and need not be described herein in detail. Generally, any suitable shredder mechanism 16 known in the art or developed hereafter may be used.

The shredder 10 also includes the shredder housing 14, mentioned above. The shredder housing 14 includes top wall 24 that sits atop the container 12. The top wall 14 is molded from plastic and has an opening 26 near the front thereof, which is formed in part by a downwardly depending generally U-shaped member 28. The opening 26 allows waste to be discarded into the container 12 without being passed through the shredder mechanism 16, and the member 28 may act as a handle for carrying the shredder 10 separate from the container 12. As an optional feature, this opening 26 may be provided with a lid, such as a pivoting lid, that opens and closes the opening 26. However, this opening in general is optional and may be omitted entirely. Moreover, the shredder housing 14 and its top wall 24 may have any suitable construction or configuration.

The shredder housing 14 also includes a bottom receptacle 30 having a bottom wall, four side walls, and an open top. The shredder mechanism 16 is received therein, and the receptacle 30 is affixed to the underside of the top wall 24 by fasteners 32 inserted through bores in posts 34 on the receptacle 30 and engaged with corresponding bores in posts 35 (see FIGS. 5 and 6). The receptacle 30 has a downwardly facing opening 31 for permitting shredded articles to be discharged from the shredder mechanism 16 into the container 12.

The top wall 24 has a generally laterally extending opening 36 extending generally parallel and above the cutter elements 20. The opening 36, often referred to as a throat, enables the articles being shredded to be fed into the cutter elements 20. As can be appreciated, the opening 36 is relatively narrow, which is desirable for preventing overly thick items, such as large stacks of documents, from being fed into cutter elements 20, which could lead to jamming. The opening 36 may have any configuration.

The top wall 24 also has a switch recess 38 with an opening 40 therethrough. An on/off switch 42 includes a switch module 44 (FIGS. 4A–6) mounted to the top wall 24 underneath the recess 38 by fasteners 45, and a manually engageable portion 46 that moves laterally within the recess 38. The switch module 44 has a movable element 48 that connects to the manually engageable portion 46 through the opening 40. This enables movement of the manually engageable portion 46 to move the switch module between its states.

In the illustrated embodiment, the switch module 44 connects the motor 18 to the power supply (not shown). Typically, the power supply will be a standard power cord 47 with a plug 49 on its end that plugs into a standard AC outlet, but any suitable manner of power delivery may be used. The switch 42 is movable between an on position and an off position by moving the portion 46 laterally within the recess 38. In the on position, contacts in the switch module 44 are closed by movement of the manually engageable portion 46 and the movable element 48 to enable a delivery of electrical power to the motor 18. In the off position, contacts in the switch module 44 are opened to disable the delivery of electric power to the motor 18.

As an option, the switch 42 may also have a reverse position wherein contacts are closed to enable delivery of electrical power to operate the motor 18 in a reverse manner. This would be done by using a reversible motor and applying a current that is of a reverse polarity relative to the on position. The capability to operate the motor 18 in a reversing manner is desirable to move the cutter elements 20 in a reversing direction for clearing jams. In the illustrated embodiment, in the off position the manually engageable portion 46 and the movable element 48 would be located generally in the center of the recess 38, and the on and reverse positions would be on opposing lateral sides of the off position.

Generally, the construction and operation of the switch 42 for controlling the motor 42 are well known and any construction for such a switch 42 may be used.

The top cover 24 also includes another recess 50 associated with a switch lock 52. The switch lock 52 includes a manually engageable portion 54 that is movable by a user's hand and a locking portion 56 (FIGS. 4A–6). The manually engageable portion 54 is seated in the recess 50 and the locking portion 56 is located beneath the top wall 24. The locking portion 56 is illustrated as being integrally formed as a plastic piece with the manually engageable portion 54 and extends beneath the top wall 24 via an opening 58 formed in the recess 50.

The recess 50 also has a pair of slots 60 on the opposing lateral sides thereof. The manually engageable portion 54 has resilient catch members 62 with flared ends that are inserted into these slots 60 so as to securely mount the switch lock 52 for sliding movement within the recess 50.

The switch module 44 is mounted so as to define a small space between it and the underside of the top wall 24. The movable element 48 of the switch 42 extends through this space. The locking portion 56 of the switch lock 52 has a switch receiving recess 64 with a pair of angled camming surfaces 66, 68 on opposing sides thereof. This construction causes the switch 42 to move from either its on position or reverse position to its off position as the switch lock 52 is moved from a releasing position to a locking position. In the releasing position, the locking portion 56 is disengaged from the movable element 48 of the switch 42, thus enabling the switch 42 to be moved between its on, off, and reverse positions. In the locking position, the switch lock 52 extends into the space between the module 44 and the top wall 24 so that the movable element 48 is received in its off position in the recess 64 and restrained against movement to either its on or reverse position.

The camming surfaces 66, 68 are provided to move the switch 42 to its off position as the switch lock 52 is moved from its releasing position to its locking position. Specifically, when the switch 42 is in the on position, cam surface 66 will engage the movable element 48 of the switch 42 and cam the same so as to move the switch 42 into the off position with the movable element 48 thereafter restrained against movement from its off position. Likewise, when the switch 42 is in the reverse position, cam surface 68 will engage the movable element 48 and cam the same so as to move the switch 42 to the off position with the movable element 48 thereafter restrained from movement from its off position. FIGS. 4A–6 best illustrate these features of this embodiment of the invention.

In embodiments where the switch 42 has no reverse position, the corresponding cam surface 68 may be omitted. Also, the switch lock 52 may be constructed to move the switch 42 from the on and/or reverse position to the off position as the switch lock 52 moves from the releasing position to the locking position by any suitable arrangement, and the cam surface(s) are not intended to be limiting. For example, mechanical links or other structures may be used. Moreover, it is not necessary to have the switch lock 52 move the switch 42 into its off position. Instead, the switch lock 52 could be constructed so that the switch 42 is manually moved to its off position prior to moving the switch lock 52 to its locking position.

Preferably, but not necessarily, the manually engageable portion 54 of the switch lock 52 has an upwardly extending projection 70 for facilitating movement of the switch lock 56 between the locking and releasing positions.

One advantage of the switch lock 52 is that, by holding the switch 42 in the off position, to activate the shredder mechanism 16 the switch lock 52 must first be moved to its releasing position, and then the switch 42 is moved to its on or reverse position. This reduces the likelihood of the shredder mechanism 16 being activated unintentionally.

FIGS. 7–11B illustrate another embodiment of a shredder 100. This shredder 100 shares many common features with the shredder 10 of the first embodiment, and those common features are marked with the same reference numerals.

The primary difference between shredder 10 and shredder 100 is the cover 102. The cover 102 is seated within a recess 103 formed in the top wall 24 and can move between open and closed positions. In the closed position, the cover 102 covers the opening 36 to prevent articles from being fed into the housing 14 and into the cutter elements 20. In the open position, the cover 102 uncovers the opening 36 to allow the articles to be shredded to be fed into the housing 14 and into the cutter elements 20. Specifically, the cover 102 has an opening 104 shaped similarly to opening 36. In the open position, these openings 36, 104 are aligned to enable feeding of articles through the openings 36, 104 and into the cutter elements 20. In the closed position, these openings 36, 104 are out of alignment, thus preventing such feeding of articles into the cutter elements 20.

In this embodiment, switch lock 52 is integrated as a molded part with the cover 102. Basically, the manually engageable portion 54 illustrated in the previous embodiment is eliminated and the locking portion 56 is formed integrally with the cover 102 (see FIGS. 11A and 11B). As a result, the cover 102 and the switch lock (i.e., locking portion 56) move together between (a) the open position of the cover 102 and the releasing position of the switch lock 52, and (b) the closed position of the cover 102 and the locking position of the switch lock 52.

As a result of this construction, if the switch 42 is left in the on or reverse position, the user can simply move the cover 102 to its closed position to simultaneously close the opening 36 and move the switch 42 to its off position by the camming action of locking portion 56 moving to its locking position. Of course, if the locking portion 56 is of the type where it does not move the switch 42 to its off position as during movement to the locking position, then the user would first move the switch 42 to its off position. In either case, to use the shredder, the user first moves the cover 102 to its open position, which simultaneously moves the locking portion 56 to its releasing position. Then, the switch 42 can be moved to the on position (or the reverse position if needed).

The switch lock 52 and the cover 102 need not be linked by being integrally formed together as one piece, and they could be formed separately and linked together for movement in any suitable way. Also, the cover 102 could be independent from the switch lock 52, with the same type of switch lock being used as is used in the first embodiment.

The cover 102 also has an upwardly extending ridge 114 for facilitating movement of the cover 102 and the switch lock 52.

Figure 1:
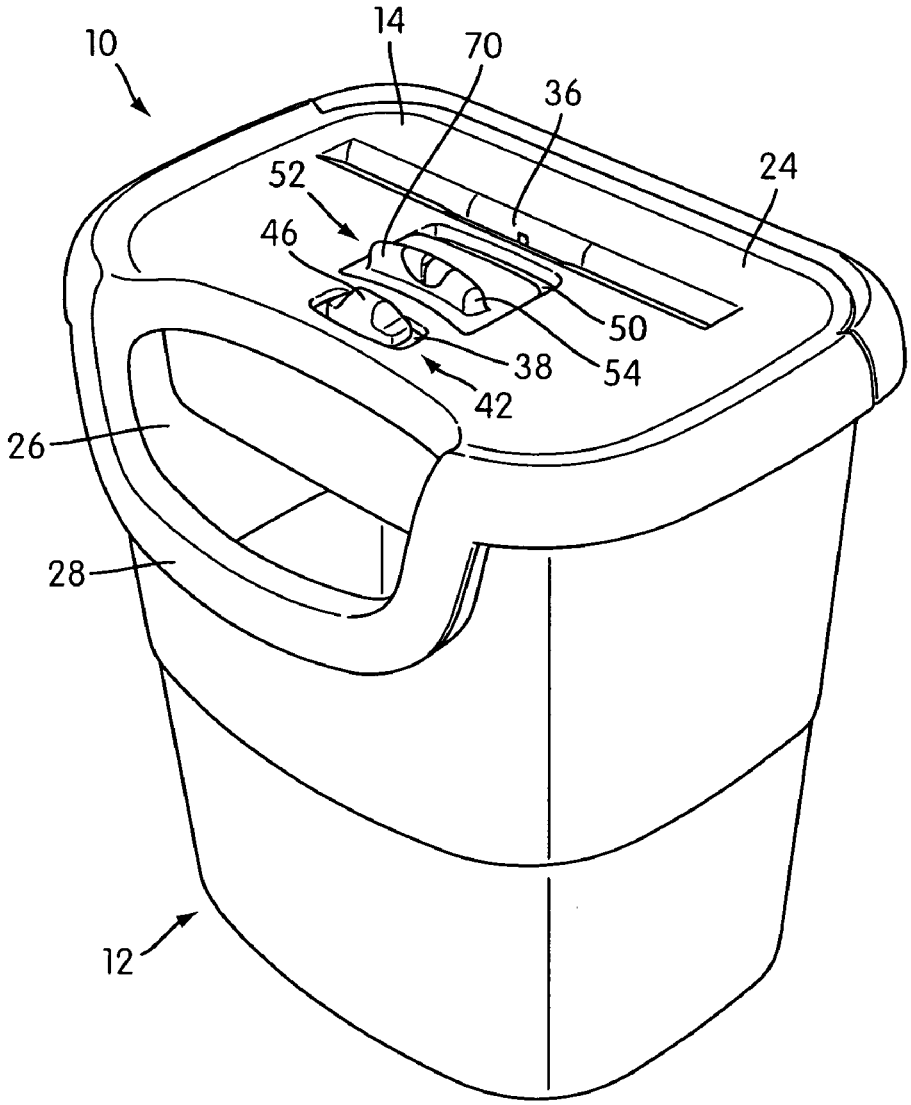
FIG. 1 is a perspective view of a shredder seated atop a container with a switch lock thereof in a locking position.
Figure 1A:
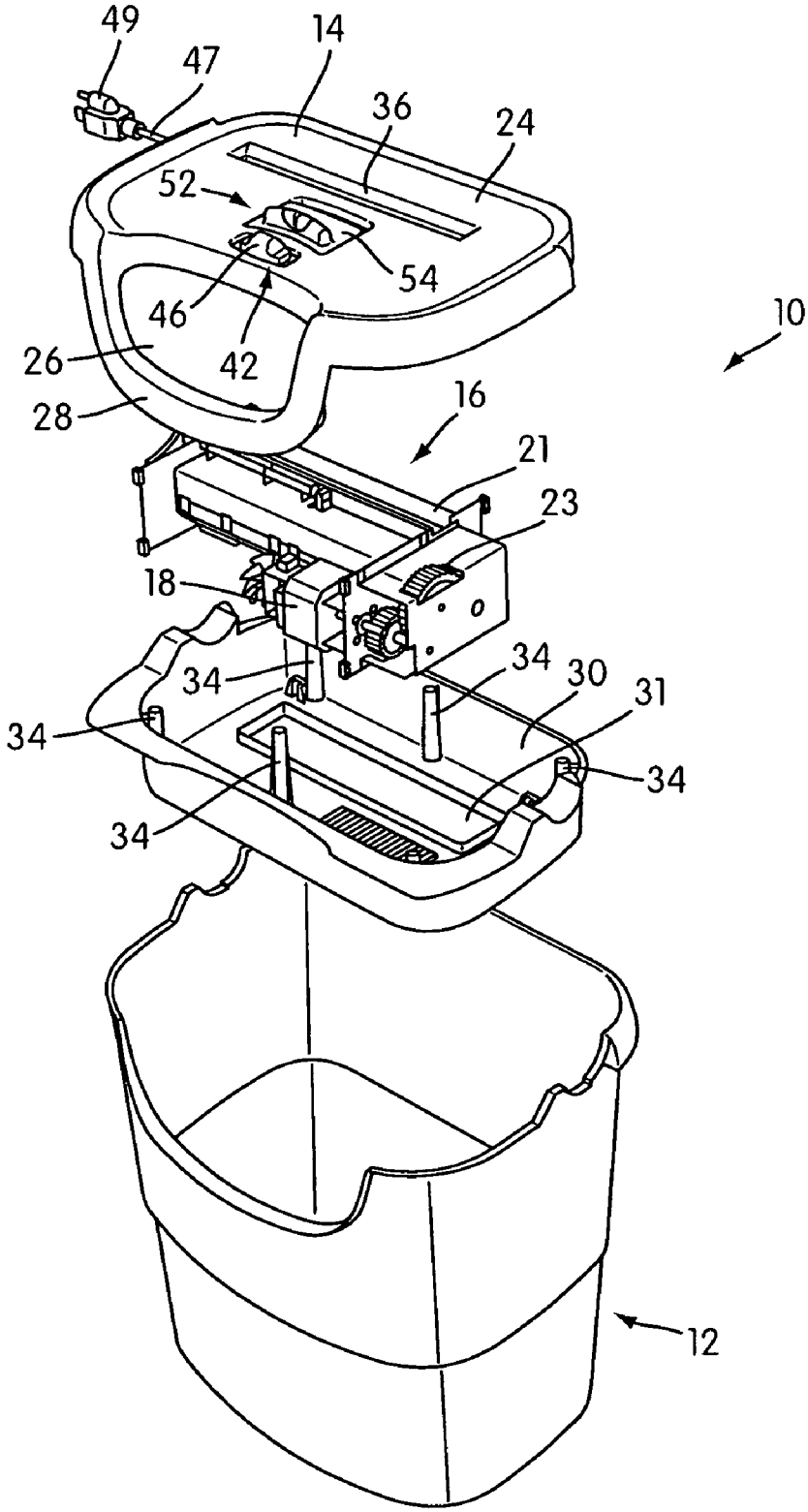
FIG. 1A is a perspective exploded view of the shredder of FIG. 1.
Figure 2:
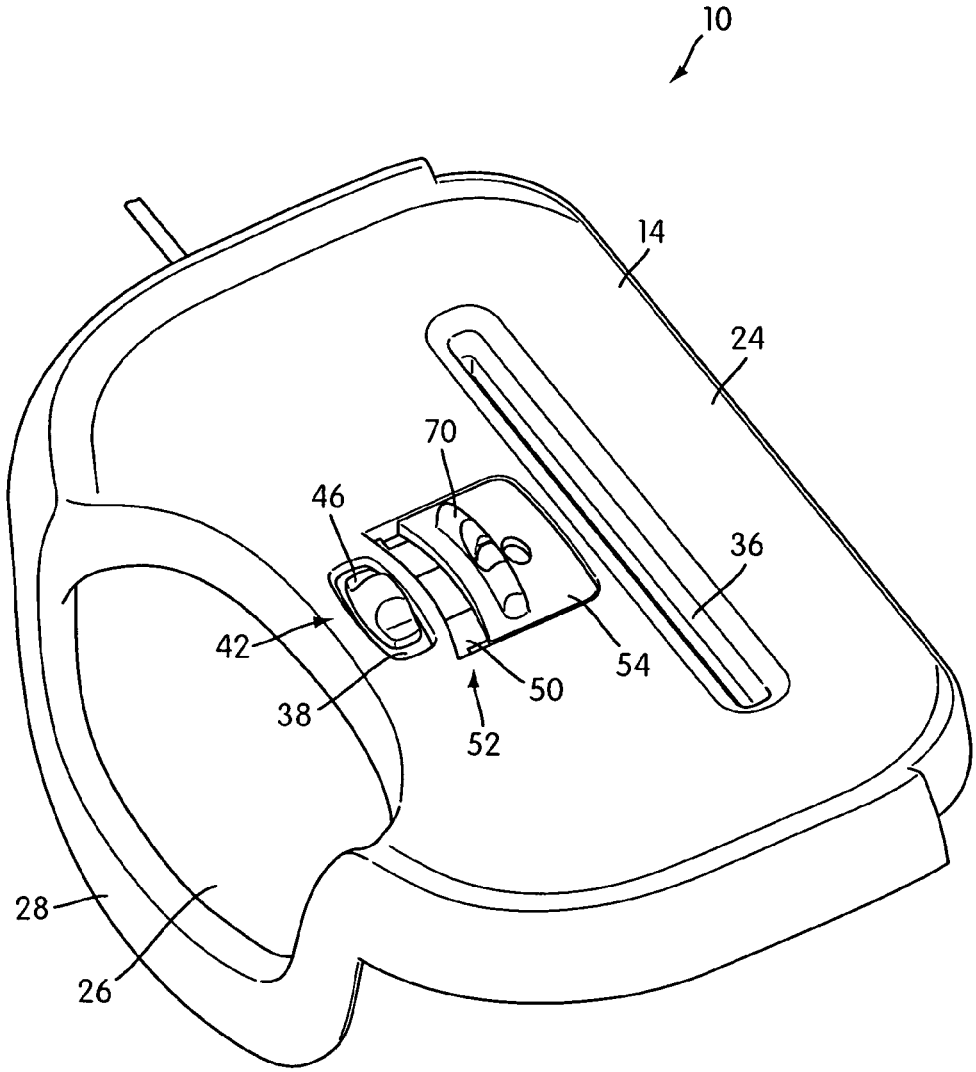
FIG. 2 is a perspective view of the shredder of Figure without the container and with the switch lock in the releasing position thereof.
Figure 3:
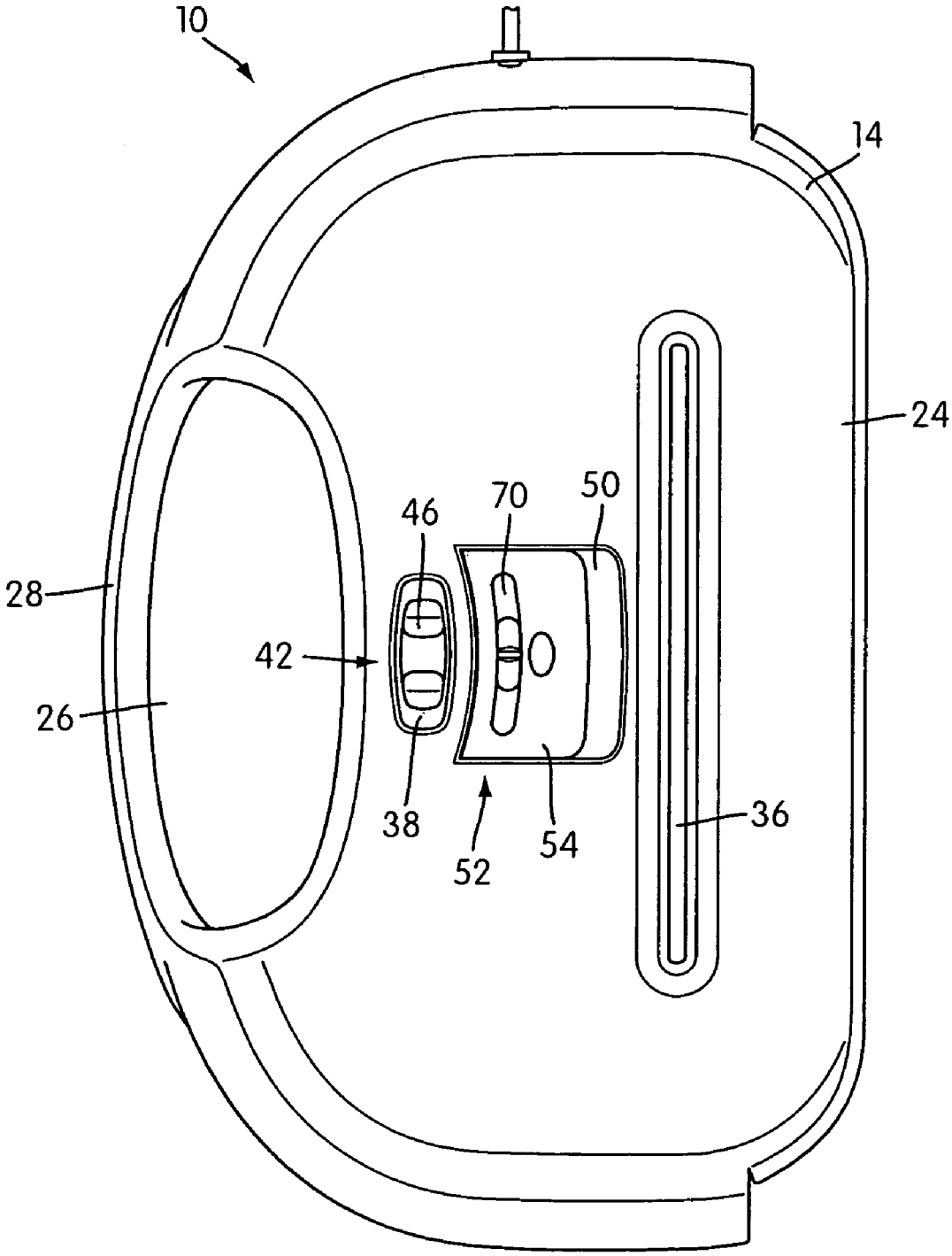
FIG. 3 is a top plan view of the shredder of FIG. 1 without the container and with the switch lock in the locking position.
Figure 4A:
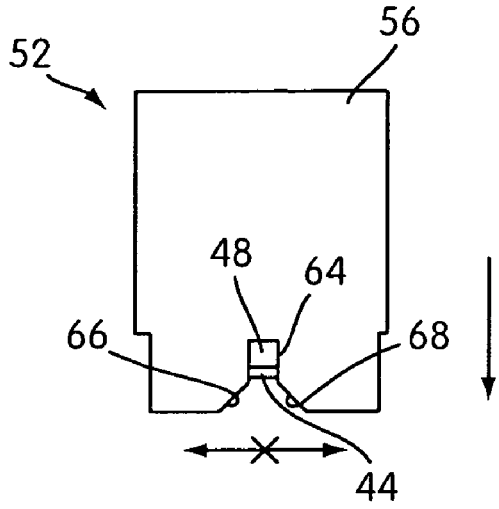
FIG. 4A is a top plan view showing the switch lock, an on/off switch of the shredder in isolation from the remainder of the shredder with the switch lock in the locking position.
Figure 4B:
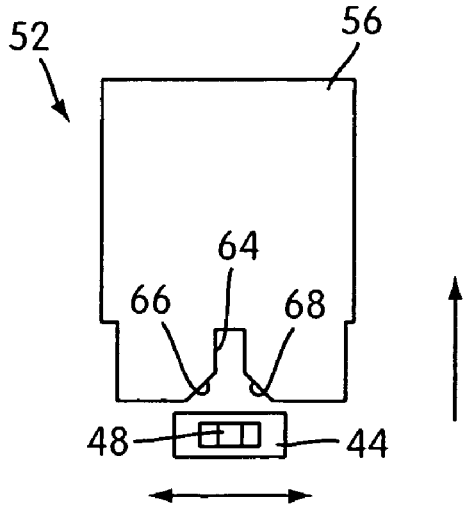
FIG. 4B is a view similar to FIG. 4A, but with the switch lock in the releasing position.
Figure 5:
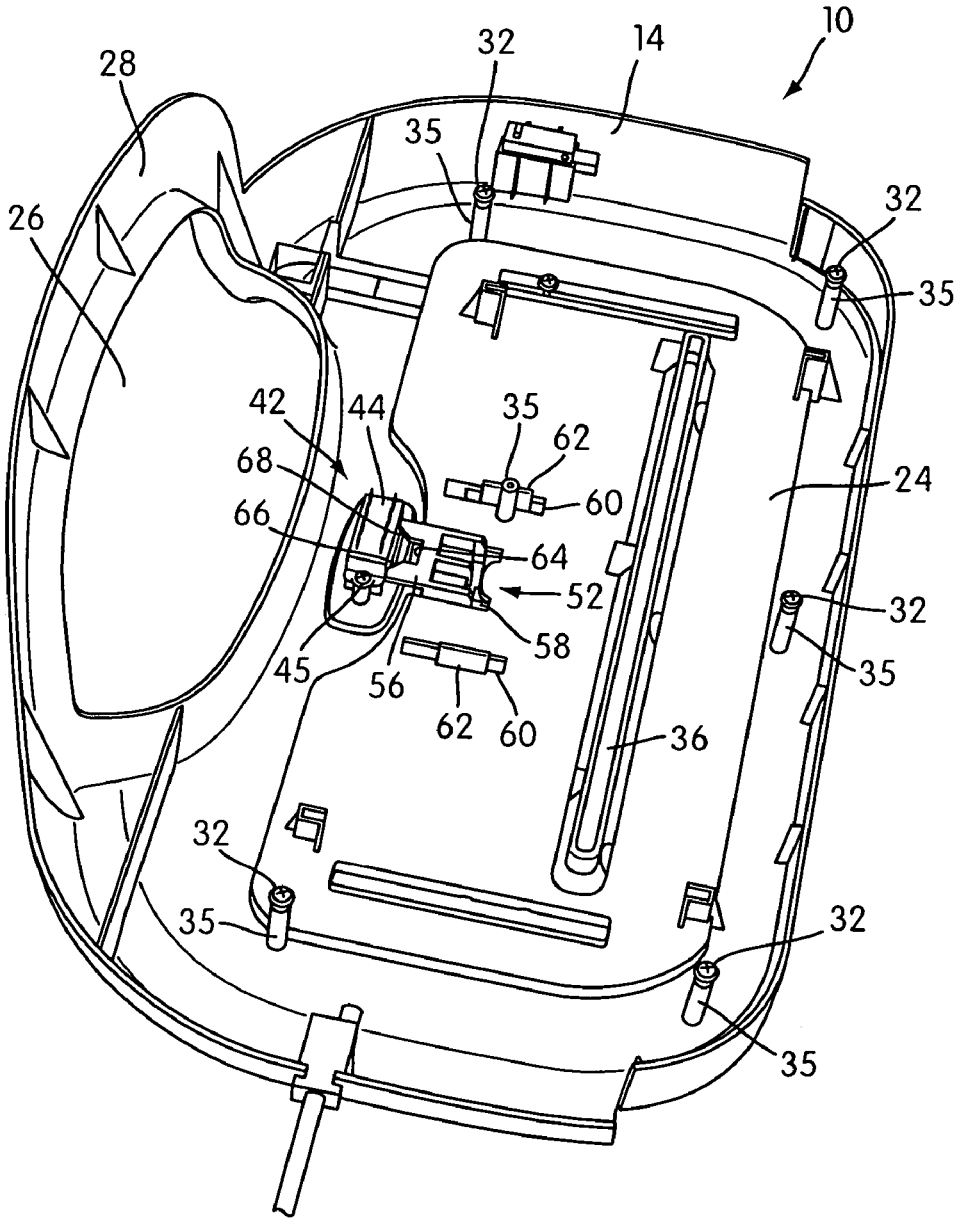
FIG. 5 is a bottom perspective view of the shredder of FIG. 1 with the shredder unit mechanism removed and the switch lock in the releasing position.
Figure 6:
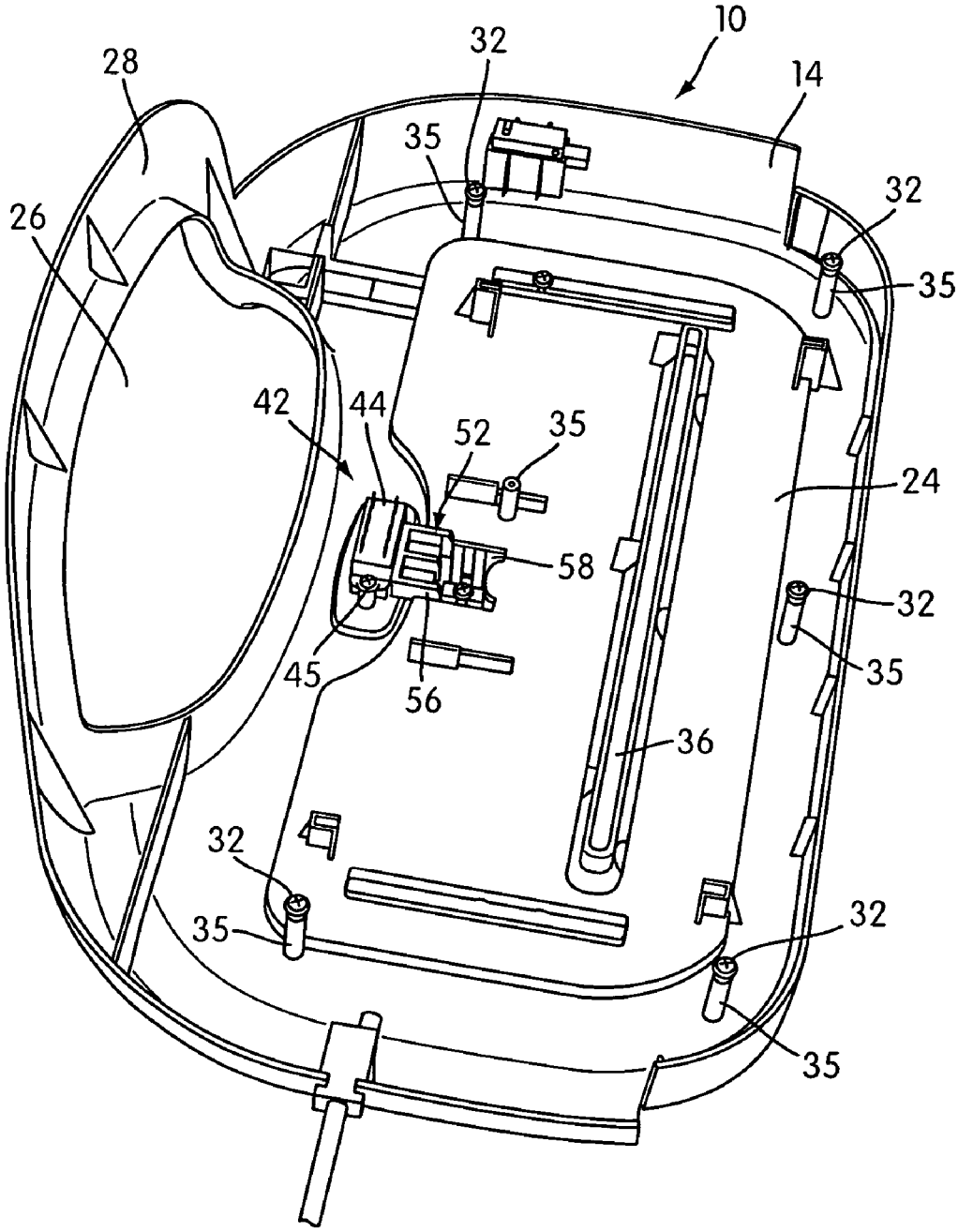
FIG. 6 is a view similar to FIG. 5 with the switch lock in the locking position.
Figure 7:
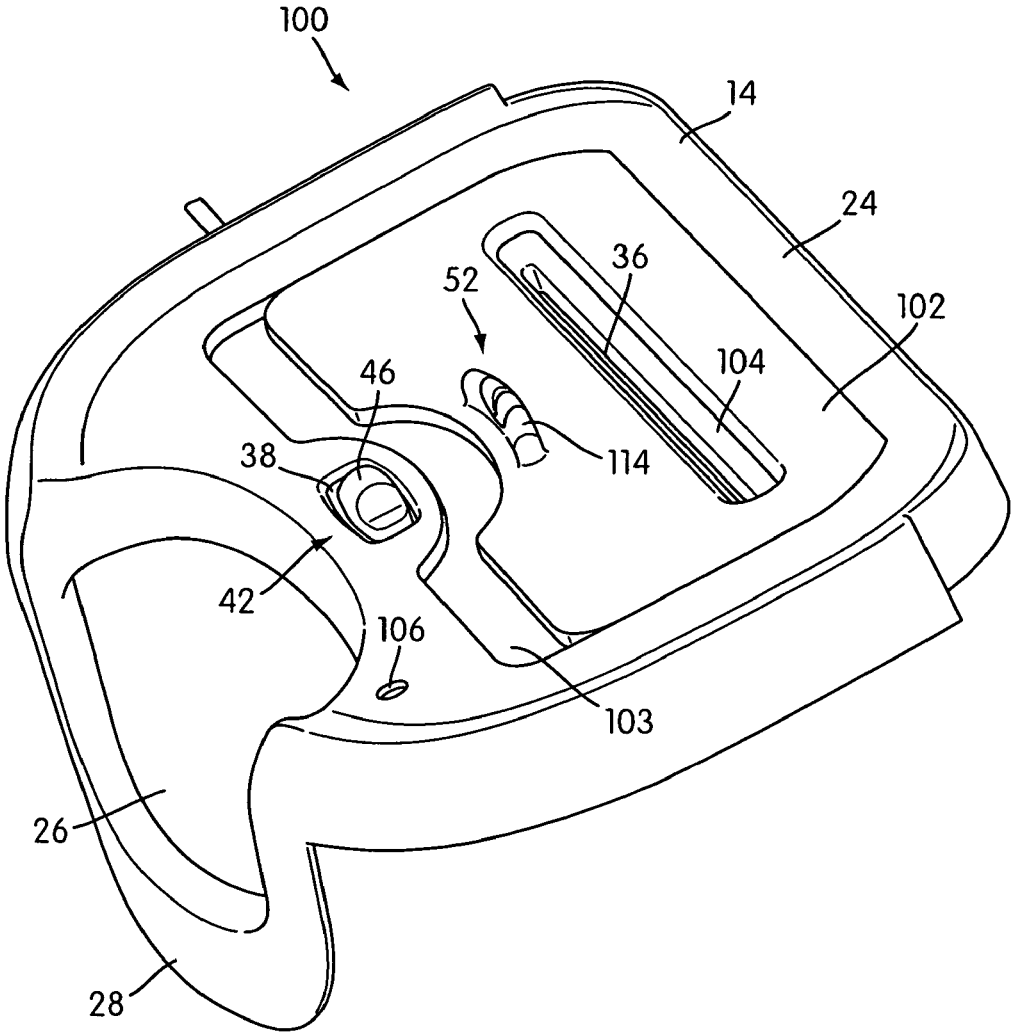
FIG. 7 is a perspective view of an alternative embodiment of a shredder with the container omitted, wherein the switch lock and throat cover move together, with the switch lock in the releasing position and the throat cover in the open position.
Figure 8:
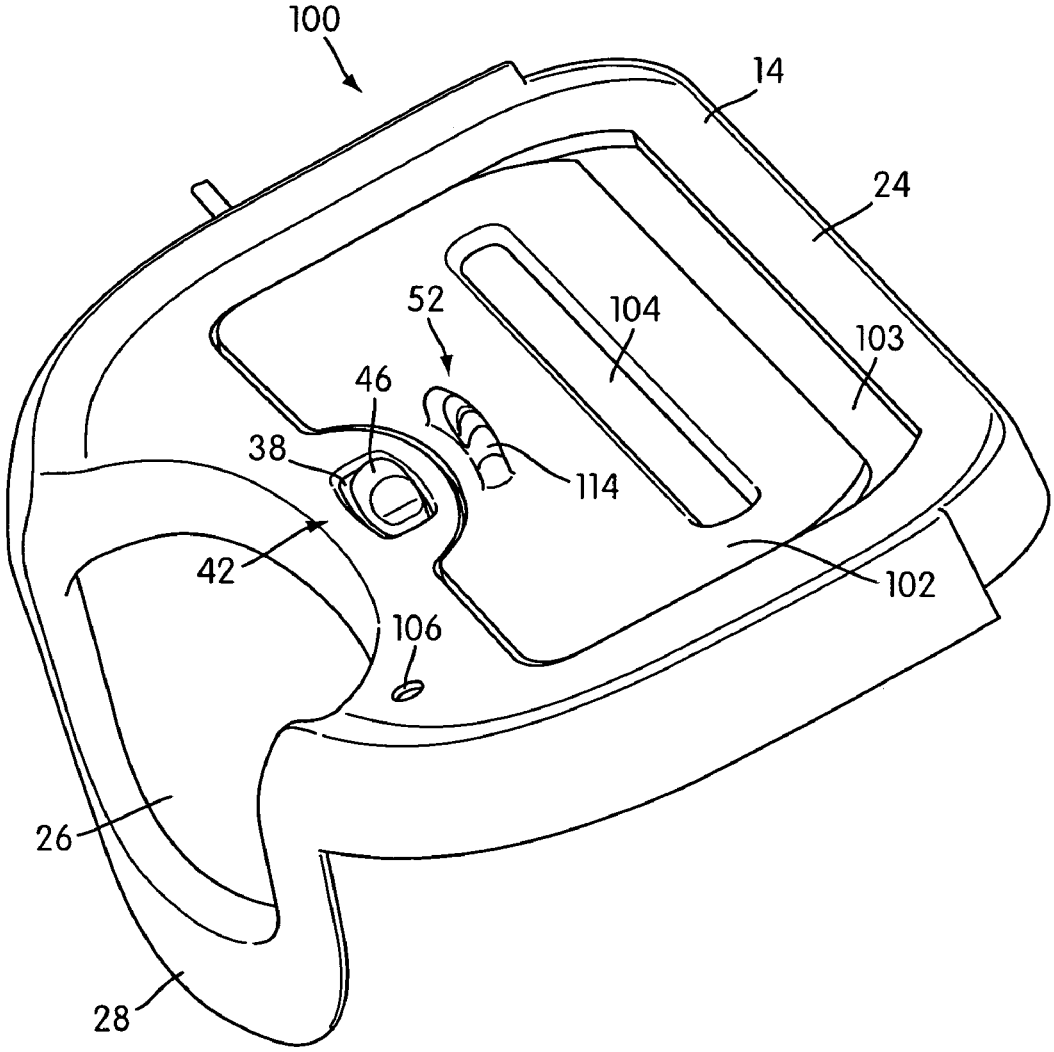
FIG. 8 is a perspective view similar to FIG. 7, but with the switch lock in the locking position and the throat cover in the closed position.
Figure 9:
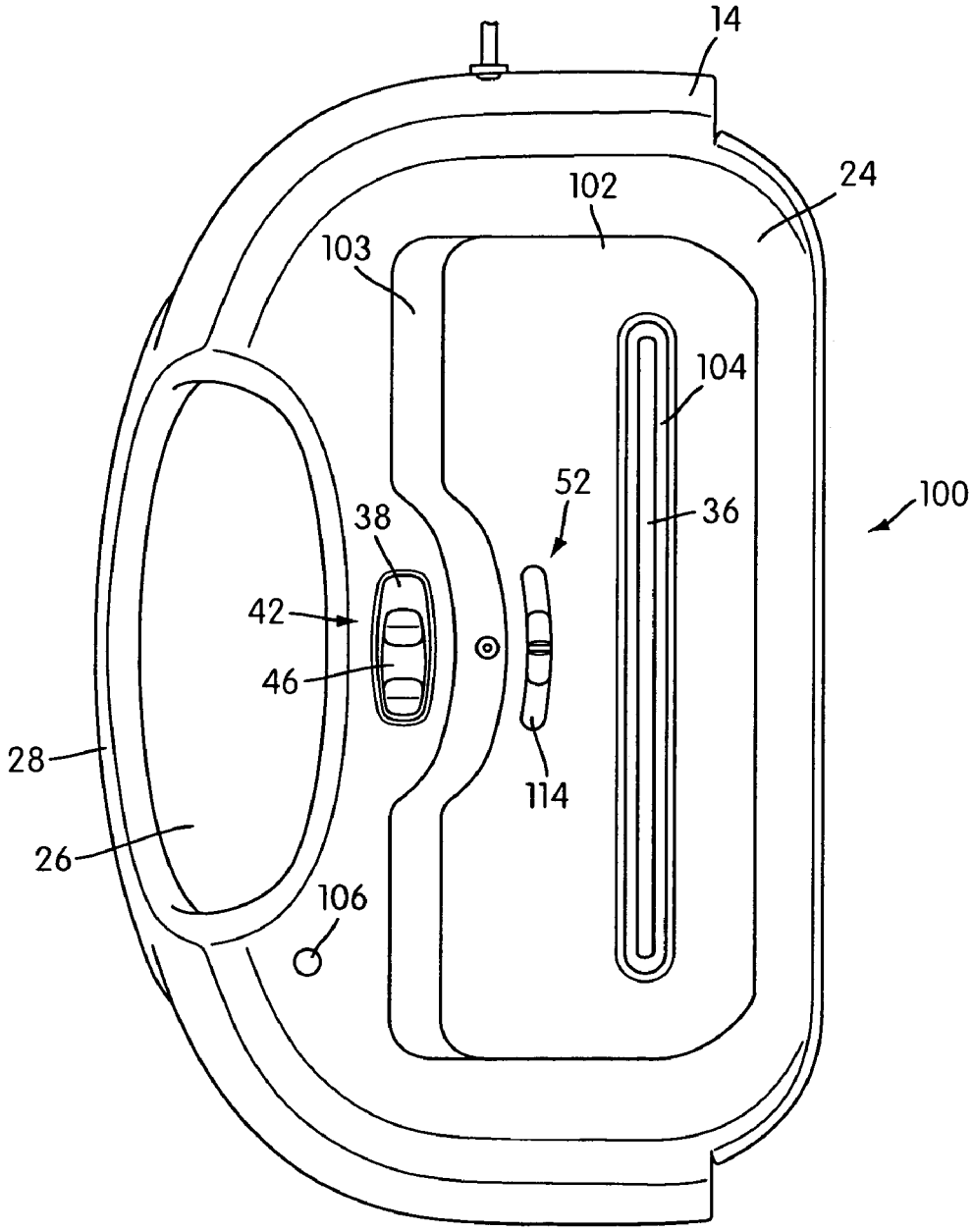
FIG. 9 is a top plan view of the shredder of FIG. 7 with the switch lock in the releasing position and the throat cover in the open position.
Figure 10:
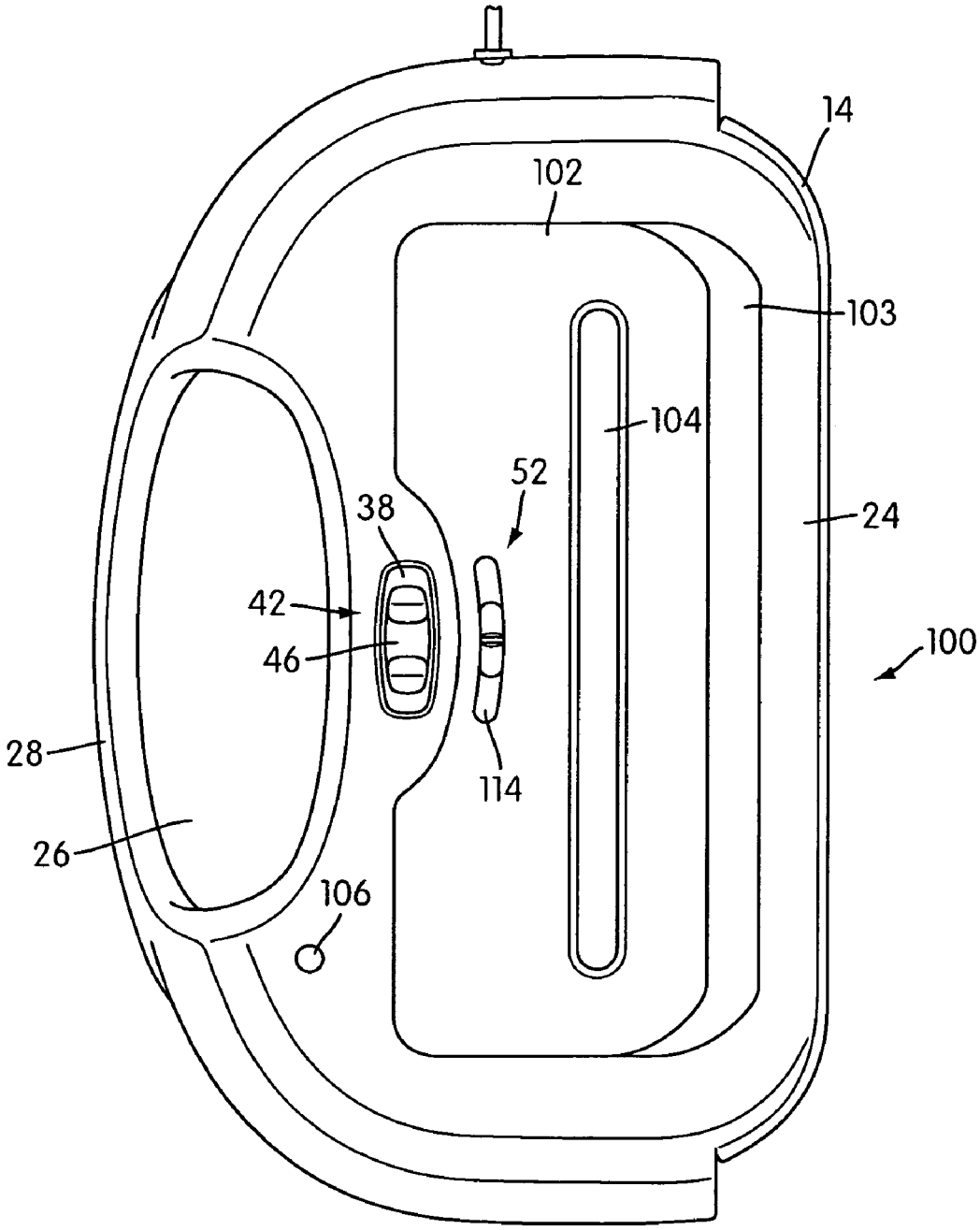
FIG. 10 is a top plan view similar to FIG. 9, but with the switch lock in the locking position and the throat cover in the closed position.
Figure 11A:
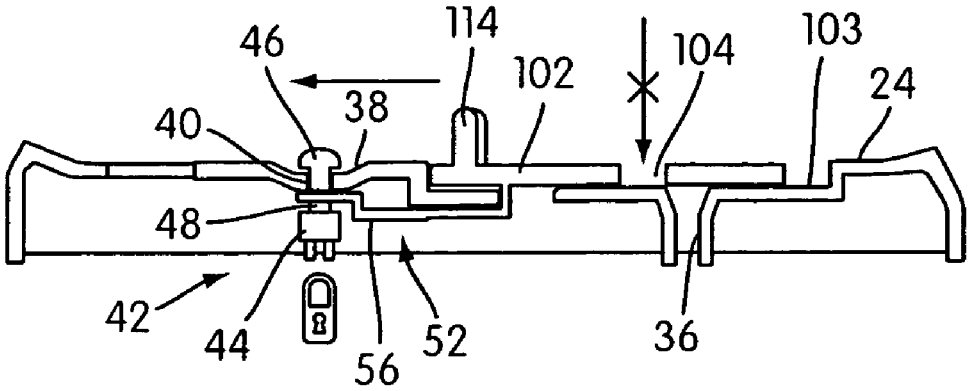
FIG. 11A is a vertical cross-section taken through the front to back centerline of the shredder of FIG. 7 with the shredder mechanism removed and with the switch lock in the locking position and the throat cover in the closed position.
Figure 11B:
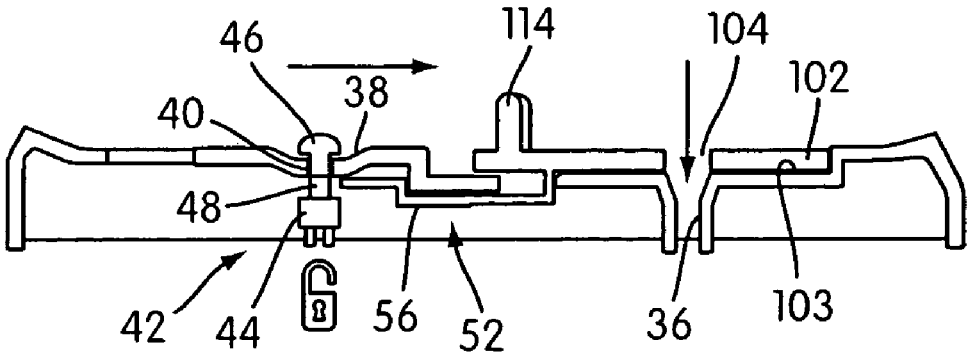
FIG. 11B is a view similar to FIG. 11A, but with the switch lock in the releasing position and the throat cover in the open position.
Figure 12A:
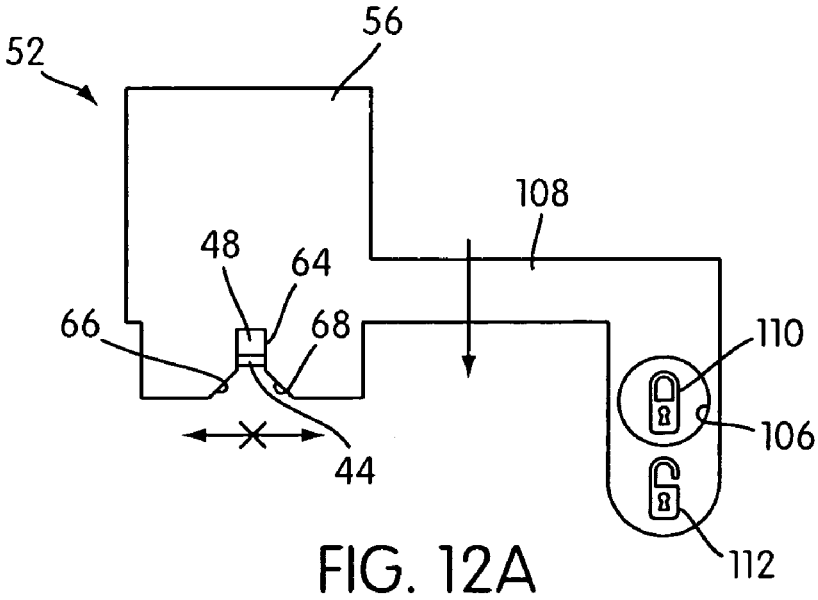
FIG. 12A is a top plan view showing the switch lock, the on/off switch of the shredder, a switch lock indicator and an indicator window of the shredder housing in isolation from the remainder of the shredder with the switch lock in the locking position.
Figure 12B:
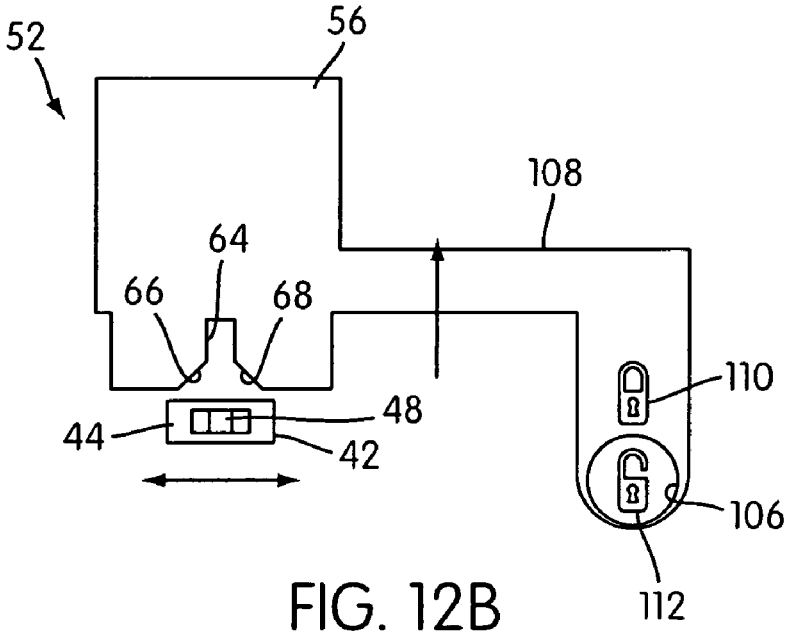
FIG. 12B is a view similar to FIG. 12A, but with the switch lock in the releasing position.

In the second embodiment illustrated, the top wall 24 also has an indicator window 106. The window 106 may simply be an opening 106, or it may have a transparent/translucent member therein. An arm 108 is formed integrally with the locking portion 56 and extends therefrom. The end of the arm 108 carries a locked indicator 110 and an unlocked indicator 112. The locked indicator 110 has the appearance of a locked padlock, and the unlocked indicator 110 has the appearance of an unlocked padlock. When the cover 102 is in the closed position and the switch lock 52 provided by locking portion 56 is in the locking position, the locked indicator 110 is located beneath the indicator window 106, enabling the user to visually see the locked indicator 100 and tell that the on/off switch 42 is locked in the off position (FIG. 12A). Likewise, when the cover 102 is in the open position and the switch lock 52 is in the releasing position, the unlocked indicator 112 is positioned beneath the window 106, enabling the user to visually see the unlocked indicator 112 and tell that the on/off switch 42 is freely movable (FIG. 12B).

Generally, this construction may be considered as providing a status indicator that visually indicates to the user whether the switch lock 52 is in the locking position. As one variation, the unlocked indicator 112 could be eliminated, providing only the locked indicator 110 to indicate that the switch lock 52 is in its locked position, with the locked indicator's absence in the window 106 indicating that switch lock 52 is in its releasing position. As another variation, one or more LEDs or other type of light may be used to indicate whether the switch lock 52 is in the locking position. Any other suitable device may be used to indicate the status of the switch lock and the examples herein should not be considered limiting.

The foregoing embodiments have been provided solely for the purposes of illustrating the structural and functional principles of the present invention, and should not be considered limiting. To the contrary, the present invention is intended to encompass all variations, modifications, and alterations within the spirit and scope of the appended claims.

What is claimed is:

1. A shredder comprising:

a housing;

a shredder mechanism mounted in the housing and including an electrically powered motor and cutter elements, the shredder mechanism enabling articles to be shredded to be fed into the cutter elements and the motor being operable to drive the cutter elements so that the cutter elements shred the articles fed therein;

a throat opening provided on the housing for enabling articles to be fed into the shredder mechanism;

an on/off switch provided on an exterior of the housing and electrically coupled to the motor of the shredder mechanism, the switch including a manually engageable portion manually movable by a user's hand between at least (a) an on position wherein the switch enables delivery of electric power to the motor and (b) an off position disabling the delivery of electric power to the motor;

a switch lock movable between (a) a locking position wherein the switch is locked in the off position and (b) a releasing position wherein the switch is released for movement from the off position;

wherein the switch lock includes a manually engageable portion provided on the exterior of the housing, the manually engageable portion being manually movable by the user's hand to move the switch lock between the locking and releasing positions.

2. A shredder according to claim 1, wherein the switch lock is constructed such that, when the on/off switch is in the on position thereof, moving the switch lock from the releasing position to the locking position causes the switch to move into the off position.

3. A shredder according to claim 2, wherein the switch is also movable to a reverse position enabling delivery of electric power to the motor so as to operate the motor to drive the cutter elements in a reverse manner, the on position and the reverse position being on opposing sides of the of position, wherein the switch lock is also constructed such that, when the on/off switch is in the reverse position, moving the switch lock from the releasing position to the locking position causes the switch to move into the off position.

4. A shredder according to claim 3, wherein the switch lock includes a pair of camming surfaces, one of the camming surfaces being configured to cam the switch from the on position to the off position as the switch lock moves from the releasing position to the locking position, the other of the camming surfaces being configured to cam the switch from the reverse position to the off position as the switch lock moves from the releasing position to the locking position.

5. A shredder according to claim 2, wherein the switch lock includes a camming surface configured to cam the switch from the on position to the off position as the switch lock moves from the releasing position to the locking position.

6. A shredder according to claim 1, further comprising a cover associated with the throat opening of the housing, the cover being movable between (a) a closed position covering the opening for preventing the articles to be shredded from being fed into the housing and into the cutter elements, and (b) an open position uncovering the opening for allowing the articles to be shredded to be fed into the housing and into the cutter elements.

7. A shredder according to claim 6, wherein the cover is linked with the switch lock such that the cover and the switch lock move together between (a) the open position of the cover and the releasing position of the switch lock and (b) the closed position of the cover and the locking position of the switch lock.

8. A shredder according to claim 7, wherein the cover is manually movable between the open and closed positions thereof, thereby enabling manual movement of the cover between the open and closed positions to move the switch lock between the releasing and locking positions thereof, respectively.

9. A shredder according to claim 8, wherein the switch lock is constructed such that, when the on/off switch is in the on position thereof, moving the switch lock from the releasing position to the locking position causes the switch to move into the off position.

10. A shredder according to claim 9, wherein the switch lock includes a camming surface configured to cam the switch from the on position to the off position as the switch lock moves from the releasing position to the locking position. operate the motor to drive the cutter elements in a reverse manner, the on position and the reverse position being on opposing sides of the off position, p1 wherein the switch lock is also constructed such that, when the on/off switch is in the reverse position, moving the switch lock from the releasing position to the locking position causes the switch to move into the off position.

11. A shredder according to claim 9, wherein the switch is also movable to a reverse position enabling delivery of electric power to the motor so as to operate the motor to drive the cutter elements in a reverse manner, the on position and the reverse position being on opposing sides of the off position, wherein the switch lock is also constructed such that, when the on/off switch is in the reverse position, moving the switch lock from the releasing position to the locking position causes the switch to move into the off position.

12. A shredder according to claim 11, wherein the switch lock includes a pair of camming surfaces, one of the camming surfaces being configured to cam the switch from the on position to the off position as the switch lock moves from the releasing position to the locking position, the other of the camming surfaces being configured to cam the switch from the reverse position to the off position as the switch lock moves from the releasing position to the locking position.

13. A shredder according to claim 1, comprising a status indicator for visually indicating whether the switch lock is in the locking position.

14. A shredder according to claim 1, wherein the housing has an upwardly facing top wall, and wherein the throat opening is formed in the top wall.

15. A shredder according to claim 14, wherein the manually engageable portion of the on/off switch is mounted for sliding movement on the top wall between the on and off positions thereof.

16. A shredder according to claim 15, wherein the top wall has an open, upwardly facing recess and wherein the manually engageable portion of the on/off switch is received in said recess.

17. A shredder according to claim 15, wherein the manually engageable portion of the switch lock is mounted for sliding movement on the top wall between the locking and releasing positions thereof.

18. A shredder according to claim 17, wherein the switch lock has a locking portion located beneath the top wall and connected to the manually engageable portion of the switch lock, the locking portion being constructed to engage a portion of the switch beneath the top wall in the locking position of the switch lock to lock the on/off switch in the off position.

19. A shredder according to claim 18, wherein the on/off switch has a switch module located beneath the top wall and connected to the motor for controlling the delivery of electrical power to the motor;

the on/off switch further comprising a movable element located at least in part beneath the top wall and connecting the manually engageable portion of the on/off switch to the switch module;

the locking portion of the switch lock being constructed to engage the movable element of the on/off switch beneath the top wall in the locking position of the switch lock to lock the on/off switch in the off position.

20. A shredder according to claim 19, wherein a space is provided beneath the top wall between the switch module and the top wall, the movable element of the on/off switch extending in said space and the locking portion of the switch lock being movable within said space to engage the movable element in the locking position of the switch lock to lock the on/off switch in the off position.

21. A shredder according to claim 20, wherein the locking portion of the switch lock includes a recess, the recess being configured to receive the movable element of the switch in the locking position of the switch lock to lock the on/off switch in the locking position.

22. A shredder comprising:

a shredder mechanism including an electrically powered motor and cutter elements, the shredder mechanism enabling articles to be shredded to be fed into the cutter elements and the motor being operable to drive the cutter elements so that the cutter elements shred the articles fed therein;

an on/off switch electrically coupled to the motor of the shredder mechanism, the switch including a manually engageable portion manually movable by a user's hand between at least (a) an on position wherein the switch enables delivery of electric power to the motor and (b) an off position disabling the delivery of electric power to the motor;

a switch lock movable between (a) a locking position wherein the switch is locked in the off position and (b) a releasing position wherein the switch is released for movement from the off position;

a housing in which the shredder mechanism is received, the housing including an opening for enabling the articles to be shredded to be fed into the housing and into the cutter elements;

a cover associated with the opening of the housing, the cover being movable between (a) a closed position covering the opening for preventing the articles to be shredded from being fed into the housing and into the cutter elements, and (b) an open position uncovering the opening for allowing the articles to be shredded to be fed into the housing and into the cutter elements;

wherein the cover is linked with the switch lock such that the cover and the switch lock move together between (a) the open position of the cover and the releasing position of the switch lock and (b) the closed position of the cover and the locking position of the switch lock.

23. A shredder according to claim 22, wherein the cover is manually movable between the open and closed positions thereof, thereby enabling manual movement of the cover between the open and closed positions to move the switch lock between the releasing and locking positions thereof, respectively.

24. A shredder according to claim 23, wherein the switch lock is constructed such that, when the on/off switch is in the on position thereof, moving the switch lock from the releasing position to the locking position causes the switch to move into the off position.

25. A shredder according to claim 24, wherein the switch lock includes a camming surface configured to cam the switch from the on position to the off position as the switch lock moves from the releasing position to the locking position.

26. A shredder according to claim 24, wherein the switch is also movable to a reverse position enabling delivery of electric power to the motor so as to operate the motor to drive the cutter elements in a reverse manner, the on position and the reverse position being on opposing sides of the off position, wherein the switch lock is also constructed such that, when the on/off switch is in the reverse position, moving the switch lock from the releasing position to the locking position causes the switch to move into the off position.

27. A shredder according to claim 26, wherein the switch lock includes a pair of camming surfaces, one of the camming surfaces being configured to cam the switch from the on position to the off position as the switch lock moves from the releasing position to the locking position, the other of the camming surfaces being configured to cam the switch from the reverse position to the off position as the switch lock moves from the releasing position to the locking position.

28. A shredder comprising:

a shredder mechanism including an electrically powered motor and cutter elements, the shredder mechanism enabling articles to be shredded to be fed into the cutter elements and the motor being operable to drive the cutter elements so that the cutter elements shred the articles fed therein;

an on/off switch electrically coupled to the motor of the shredder mechanism, the switch including a manually engageable portion manually movable by a user's hand between at least (a) an on position wherein the switch enables delivery of electric power to the motor and (b) an off position disabling the delivery of electric power to the motor;

a switch lock movable between (a) a locking position wherein the switch is locked in the off position and (b) a releasing position wherein the switch is released for movement from the off position;

wherein the switch lock includes a manually engageable portion manually movable by the user's hand to move the switch lock between the locking and releasing positions;

wherein the switch lock is constructed such that, when the on/off switch is in the on position thereof, moving the switch lock from the releasing position to the locking position causes the switch to move into the off position;

wherein the switch is also movable to a reverse position enabling delivery of electric power to the motor so as to operate the motor to drive the cutter elements in a reverse manner, the on position and the reverse position being on opposing sides of the off position, wherein the switch lock is also constructed such that, when the on/off switch is in the reverse position, moving the switch lock from the releasing position to the locking position causes the switch to move into the off position;

wherein the switch lock includes a pair of camming surfaces, one of the camming surfaces being configured to cam the switch from the on position to the off position as the switch lock moves from the releasing position to the locking position, the other of the camming surfaces being configured to cam the switch from the reverse position to the off position as the switch lock moves from the releasing position to the locking position.

29. A shredder comprising:

a housing;

a shredder mechanism including an electrically powered motor and cutter elements, the shredder mechanism enabling articles to be shredded to be fed into the cutter elements and the motor being operable to drive the cutter elements so that the cutter elements shred the articles fed therein;

a throat opening provided on the housing for enabling articles to be fed into the shredder mechanism;

an on/off switch provided on an exterior of the housing and electrically coupled to the motor of the shredder mechanism, the switch including a manually engageable portion manually movable by a user's hand between at least (a) an on position wherein the switch enables delivery of electric power to the motor and (b) an off position disabling the delivery of electric power to the motor;

a switch lock movable between (a) a locking position wherein the switch is locked in the off position and (b) a releasing position wherein the switch is released for movement from the off position;

wherein the switch lock includes a manually engageable portion provided on the exterior of the housing, the manually engageable portion being manually movable by the user's hand to move the switch lock between the locking and releasing positions; and wherein the switch lock is constructed such that, when the on/off switch is in the on position thereof, moving the switch lock from the releasing position to the locking position causes the switch to move into the off position.

30. A shredder according to claim 29, wherein the switch lock includes a camming surface configured to cam the switch from the on position to the off position as the switch lock moves from the releasing position to the locking position.

31. A shredder according to claim 30, wherein the switch is also movable to a reverse position enabling delivery of electric power to the motor so as to operate the motor to drive the cutter elements in a reverse manner, the on position and the reverse position being on opposing sides of the off position, wherein the switch lock is also constructed such that, when the on/off switch is in the reverse position, moving the switch lock from the releasing position to the locking position causes the switch to move into the off position.

32. A shredder according to claim 31, wherein the housing has an upwardly facing top wall, wherein the throat opening is formed in the top wall, and wherein the manually engageable portion of the switch lock is mounted for linear sliding movement on the top wall between the on and off positions thereof.

33. A shredder according to claim 32, wherein the top wall has an open, upwardly facing recess and wherein the manually engageable portion is received in said recess.

34. A shredder comprising:

a housing;

a shredder mechanism including an electrically powered motor and cutter elements, the shredder mechanism enabling articles to be shredded to be fed into the cutter elements and the motor being operable to drive the cutter elements so that the cutter elements shred the articles fed therein;

a throat opening provided on the housing for enabling articles to be fed into the shredder mechanism;

an on/off switch provided on an exterior of the housing and electrically coupled to the motor of the shredder mechanism, the switch including a manually engageable portion manually movable by a user's hand between at least (a) an on position wherein the switch enables delivery of electric power to the motor and (b) an off position disabling the delivery of electric power to the motor;

a switch lock movable between (a) a locking position wherein the switch is locked in the off position and (b) a releasing position wherein the switch is released for movement from the off position;

wherein the switch lock includes a manually engageable portion provided on an exterior of the housing, the manually engageable portion being manually movable by the user's hand to move the switch lock between the locking and releasing positions; and a status indicator provided on the exterior of the housing for visually indicating whether the switch lock is in the locking position.

35. A shredder according to claim 34, wherein the housing has an upwardly facing top wall, wherein the throat opening is formed in the top wall, and wherein the manually engageable portion of the switch lock is mounted for linear sliding movement on the top wall between the on and off positions thereof.

36. A shredder according to claim 35, wherein the top wall has an open, upwardly facing recess and wherein the manually engageable portion is received in said recess.

37. A shredder comprising:

a housing;

a shredder mechanism including an electrically powered motor and cutter elements, the shredder mechanism enabling articles to be shredded to be fed into the cutter elements and the motor being operable to drive the cutter elements so that the cutter elements shred the articles fed therein;

a throat opening provided on the housing for enabling articles to be fed into the shredder mechanism;

an on/off switch provided on an exterior of the housing and electrically coupled to the motor of the shredder mechanism, the switch including a manually engageable portion manually movable by a user's hand between at least (a) an on position wherein the switch enables delivery of electric power to the motor and (b) an off position disabling the delivery of electric power to the motor;

a switch lock movable between (a) a locking position wherein the switch is locked in the off position and (b) a releasing position wherein the switch is released for movement from the off position;

wherein the switch lock includes a manually engageable portion provided on an exterior of the housing, the manually engageable portion being manually movable by the user's hand to move the switch lock between the locking and releasing positions; and the switch lock including a locking portion connected to the manually engageable portion of the switch lock, the locking portion including a recess configured to receive a portion of the on/off switch in the locking position of the switch lock to lock the on/off switch in the off position.

* * * * *

UNITED STATES PATENT AND TRADEMARK OFFICE

CERTIFICATE OF CORRECTION

PATENT NO. : 7,040,559 B2
APPLICATION NO. : 10/815761
DATED : May 9, 2006
INVENTOR(S) : Matlin et al.

It is certified that error appears in the above-identified patent and that said Letters Patent is hereby corrected as shown below:

Column 7, line 5 is amended to read:

--and the reverse position being on opposing sides of the off--.

Column 7, line 55, after the word --position.--, please delete the remainder of the claim.

Signed and Sealed this

First Day of August, 2006

JON W. DUDAS
*Director of the United States Patent and Trademark Office*

US007040559C1

(12) EX PARTE REEXAMINATION CERTIFICATE (6324th)

United States Patent

Matlin et al.

(10) Number: US 7,040,559 C1

(45) Certificate Issued: Jul. 22, 2008

(54) SHREDDER WITH LOCK FOR ON/OFF SWITCH

(75) Inventors: Taihoon K. Matlin, Round Lake Beach, IL (US); David G. Hartnett, Carol Stream, IL (US)

(73) Assignee: Fellowes Inc., Itasca, IL (US)

Reexamination Request:
No. 90/008,455, Jan. 30, 2007

Reexamination Certificate for:

| | |
|---|---|
| Patent No.: | **7,040,559** |
| Issued: | **May 9, 2006** |
| Appl. No.: | **10/815,761** |
| Filed: | **Apr. 2, 2004** |

Certificate of Correction issued Aug. 1, 2006.

(51) Int. Cl.
*B02C 25/00* (2006.01)

(52) U.S. Cl. ..... 241/36; 241/37.5; 241/100; 241/101.3

(58) Field of Classification Search ..... None
See application file for complete search history.

(56) References Cited

U.S. PATENT DOCUMENTS

| | | | |
|---|---|---|---|
| 1,525,590 | A | 2/1925 | Perrault |
| 1,825,223 | A | 9/1931 | Deck |
| 3,312,794 | A | 4/1967 | Hollyday |
| 3,619,537 | A | 11/1971 | Nara et al. |
| 3,724,766 | A | 4/1973 | Bosland |
| 3,764,819 | A | 10/1973 | Muller |
| 3,829,850 | A | 8/1974 | Guetersloh |
| 3,860,180 | A | 1/1975 | Goldhammer |
| 3,869,238 | A | 3/1975 | Racca |
| 3,947,734 | A | 3/1976 | Fyler |
| 3,991,944 | A | 11/1976 | Baikoff |
| 4,018,392 | A | 4/1977 | Wagner |
| 4,044,532 | A | 8/1977 | Lessig, III |
| 4,068,805 | A | 1/1978 | Oswald |
| 4,082,232 | A | 4/1978 | Brewer |
| 4,125,228 | A | 11/1978 | Brewer |
| 4,172,400 | A | 10/1979 | Brierley |
| 4,187,420 | A | 2/1980 | Piber |
| 4,194,698 | A | 3/1980 | Kosmowski |
| 4,352,980 | A | 10/1982 | Hibari |
| 4,420,863 | A | 12/1983 | Trimmer et al. |
| 4,471,915 | A | 9/1984 | Levin et al. |
| 4,562,971 | A | 1/1986 | Schwelling |
| 4,673,136 | A | 6/1987 | Bianco et al. |
| 4,683,381 | A | 7/1987 | Dufoug |
| 4,693,428 | A | 9/1987 | Raterman et al. |
| 4,713,509 | A | 12/1987 | Chebowski |
| 4,767,895 | A | 8/1988 | Parrish |
| 4,784,601 | A | 11/1988 | Nitta |
| 4,784,602 | A | 11/1988 | Nitta |
| 4,821,967 | A | 4/1989 | Moriyama |
| 4,839,533 | A | 6/1989 | Aga |
| 4,859,172 | A | 8/1989 | Nitta |
| 4,882,458 | A | 11/1989 | Berg et al. |
| 4,910,365 | A | 3/1990 | Kuo |
| 4,944,462 | A | 7/1990 | Raterman et al. |
| 5,045,648 | A | 9/1991 | Fogleman, Sr. |
| 5,065,947 | A | 11/1991 | Farnsworth |
| 5,081,406 | A | 1/1992 | Hughes et al. |
| 5,100,067 | A | 3/1992 | Konig et al. |

(Continued)

FOREIGN PATENT DOCUMENTS

| | | |
|---|---|---|
| CN | 99208833 | 1/2000 |
| CN | 99213588.5 | 6/2000 |
| DE | 222515 | 5/1910 |

(Continued)

OTHER PUBLICATIONS

Markman Decision from Eastern District of Virginia, *Fellowes, Inc.* v. *Michilin Prosperity Company, Ltd. and Intek America, Inc.*, Civil Action No. 2:06cv289, Dec. 15, 2006, 39 pages.

(Continued)

*Primary Examiner*—Jeffrey R. Jastrzab

(57) ABSTRACT

The present application discloses a shredder with a switch lock that locks the on/off switch in its on/off position.

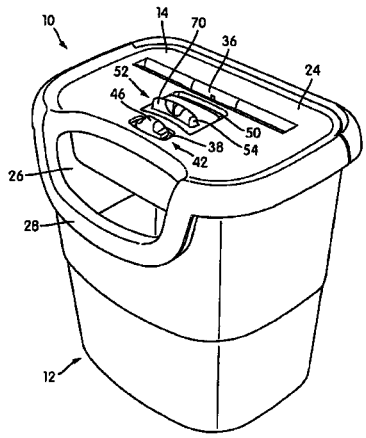

U.S. PATENT DOCUMENTS

| | | | |
|---|---|---|---|
| 5,135,178 | A | 8/1992 | Strohmeyer |
| 5,166,679 | A | 11/1992 | Vranish et al. |
| 5,171,143 | A | 12/1992 | Sohn |
| 5,186,398 | A | 2/1993 | Vigneau, Jr. |
| 5,207,392 | A | 5/1993 | Stangenberg et al. |
| 5,268,553 | A | 12/1993 | Shimoji |
| 5,275,342 | A | 1/1994 | Galanty |
| 5,279,467 | A | 1/1994 | Lydy |
| 5,295,633 | A | 3/1994 | Kimbro et al. |
| 5,345,138 | A | 9/1994 | Mukaidono et al. |
| 5,356,286 | A | 10/1994 | Sher |
| 5,397,890 | A | 3/1995 | Schueler et al. |
| 5,407,346 | A | 4/1995 | Sher |
| 5,421,720 | A | 6/1995 | Sher |
| 5,432,308 | A | 7/1995 | Howie, Jr. |
| 5,460,516 | A | 10/1995 | Sher |
| 5,494,229 | A | 2/1996 | Rokos |
| 5,568,895 | A | 10/1996 | Webb et al. |
| 5,607,295 | A | 3/1997 | Khemarangsan |
| 5,636,801 | A | 6/1997 | Kroger |
| 5,655,725 | A | 8/1997 | Kroger |
| 5,676,321 | A | 10/1997 | Kroger |
| 5,680,999 | A | 10/1997 | Wada |
| 5,704,776 | A | 1/1998 | Sher |
| 5,724,737 | A | 3/1998 | Stones |
| D393,607 | S | 4/1998 | Dandurand |
| 5,775,605 | A | 7/1998 | Tsai |
| 5,788,476 | A | 8/1998 | Sher |
| 5,829,697 | A | 11/1998 | Kroger |
| 5,829,963 | A | 11/1998 | Ichikawa |
| 5,850,342 | A | 12/1998 | Nakamura et al. |
| 5,868,242 | A | 2/1999 | Hall et al. |
| 5,884,855 | A | 3/1999 | Chang |
| RE36,250 | E | 7/1999 | Hess |
| D412,716 | S | 8/1999 | Kroger |
| 5,942,975 | A | 8/1999 | Sorenson |
| 5,988,542 | A | 11/1999 | Henreckson et al. |
| 6,065,696 | A | 5/2000 | Tsai |
| 6,079,645 | A | 6/2000 | Henreckson et al. |
| 6,082,644 | A | 7/2000 | Turner |
| 6,089,482 | A | 7/2000 | Chang |
| 6,247,828 | B1 | 6/2001 | Herst |
| D444,809 | S | 7/2001 | Chang |
| 6,260,780 | B1 | 7/2001 | Kroger et al. |
| 6,265,682 | B1 | 7/2001 | Lee |
| 6,274,828 | B1 | 8/2001 | Chu |
| 6,308,904 | B1 | 10/2001 | Chang |
| 6,325,309 | B1 | 12/2001 | Chang |
| 6,376,939 | B1 | 4/2002 | Suzuki et al. |
| 6,418,004 | B1 | 7/2002 | Mather et al. |
| 6,550,701 | B1 | 4/2003 | Chang |
| 6,575,285 | B2 | 6/2003 | Jong |
| D481,416 | S | 10/2003 | Chang |
| 6,655,943 | B1 | 12/2003 | Peterson et al. |
| 6,676,050 | B2 | 1/2004 | Chang |
| 6,676,460 | B1 | 1/2004 | Motsenbocker |
| 6,724,324 | B1 | 4/2004 | Lambert |
| D494,607 | S | 8/2004 | Hunag |
| 6,775,018 | B1 | 8/2004 | Taniguchi |
| 6,779,747 | B2 | 8/2004 | McLean et al. |
| D502,713 | S | 3/2005 | Hunag |
| D502,714 | S | 3/2005 | Hunag |
| 6,962,301 | B1 | 11/2005 | Chang |
| 6,966,513 | B2 | 11/2005 | Chang |
| 6,976,648 | B2 | 12/2005 | Chang |
| 6,979,813 | B2 | 12/2005 | Avril |
| 6,981,667 | B2 | 1/2006 | Hunag |
| 7,040,559 | B2 | 5/2006 | Matlin et al. |
| 7,044,410 | B2 | 5/2006 | Hunag |
| 7,048,218 | B2 | 5/2006 | Hunag |
| 7,150,422 | B2 | 12/2006 | Wang |
| 2004/0008122 | A1 | 1/2004 | Michael |
| 2004/0194594 | A1 | 10/2004 | Dils et al. |
| 2004/0226800 | A1 | 11/2004 | Pierga et al. |
| 2005/0132859 | A1 | 6/2005 | Huang |
| 2005/0157203 | A1 | 7/2005 | Nakakuki et al. |
| 2005/0166736 | A1 | 8/2005 | Gass et al. |
| 2005/0218250 | A1 | 10/2005 | Matlin et al. |
| 2005/0274834 | A1 | 12/2005 | Huang |
| 2005/0274836 | A1 | 12/2005 | Chang |
| 2006/0091247 | A1 | 5/2006 | Matlin |
| 2006/0157600 | A1 | 7/2006 | Wang |
| 2006/0169619 | A1 | 8/2006 | Wang |
| 2006/0249609 | A1 | 11/2006 | Huang |

FOREIGN PATENT DOCUMENTS

| | | |
|---|---|---|
| DE | 32 08 676 | 10/1982 |
| DE | 32 47 299 | 7/1984 |
| DE | 33 13 232 | 10/1984 |
| DE | 35 40 896 | 5/1987 |
| DE | 78 18 838 | 6/1987 |
| DE | 37 33 413 | 4/1988 |
| DE | 86 19 856.4 | 10/1988 |
| DE | 40 14 669 | 11/1991 |
| DE | 41 21 330 | 1/1993 |
| DE | 195 19 858 | 12/1996 |
| DE | 199 60 267 | 7/2000 |
| EP | 0 511 535 | 4/1992 |
| EP | 0 736 886 | 3/1996 |
| EP | 0 855 221 | 7/1998 |
| EP | 1 195 202 | 9/2001 |
| EP | 1 069 954 | 9/2002 |
| GB | 761607 | 6/1954 |
| GB | 2096919 | 10/1982 |
| GB | 2203063 | 10/1988 |
| GB | 2234690 | 2/1991 |
| JP | 52-11691 | 4/1977 |
| JP | 57-76734 | 5/1982 |
| JP | 04-157093 | 5/1992 |
| JP | 04-180852 | 6/1992 |
| JP | 4-110143 | 9/1992 |
| JP | 5-68906 | 3/1993 |
| JP | 5-123593 | 5/1993 |
| JP | 6-277548 | 10/1994 |
| JP | 7-136539 | 5/1995 |
| JP | 7-155629 | 6/1995 |
| JP | 7-299377 | 11/1995 |
| JP | 7-328469 | 12/1995 |
| JP | 8-1026 | 1/1996 |
| JP | 6-137104 | 1/1996 |
| JP | 9-262491 | 10/1997 |
| JP | 10-34003 | 2/1998 |
| JP | 11-216383 | 8/1999 |
| JP | 2000-0346288 | 12/2000 |
| JP | 2004-321993 | 11/2004 |
| TW | 306323 | 10/1985 |
| TW | 00139305 | 8/1990 |
| TW | 282696 | 8/1996 |
| TW | 84317868A01 | 5/1997 |
| WO | 98/48937 | 11/1998 |
| WO | 99/52638 | 10/1999 |
| WO | 02/060588 | 8/2002 |
| WO | 2005/070553 | 8/2005 |

OTHER PUBLICATIONS

Consent Decree from *Fellowes, Inc.* v. *Michilin Prosperity Company, Ltd. and Intek America, Inc.,* Civil Action No. 2:06cv289, Jul. 2, 2007, 8 pages.

Transcript of Closing Arguments, *Fellowes, Inc.* v. *Michilin Prosperity Company, Ltd. and Intek America, Inc.,* Civil Action No. 2:06cv289, May 14, 2007, vol. 10, pp. 1462–1547.

Transcript of Trial Testimony of Lee Swanger, *Fellowes, Inc.* v. *Michilin Prosperity Company, Ltd. and Intek America, Inc.,* Civil Action No. 2:06cv289, May 11, 2007, vol. 9, pp. 1273–1296.

Transcript of Trial Testimony of Tai Matlin and Dr. Elliot Stern, *Fellowes, Inc.* v. *Michilin Prosperity Company, Ltd. and Intek America, Inc.,* Civil Action No. 2:06cv289, May 10, 2007, vol. 9, pp. 1067–1246.

Transcript of Trial Testimony of Lee Swanger, *Fellowes, Inc.* v. *Michilin Prosperity Company, Ltd. and Intek America, Inc.,* Civil Action No. 2:06cv289, May 9, 2007, vol. 7, pp. 903–911.

Transcript of Trial Testimony of Bruce Kroger and Tai Matlin, *Fellowes, Inc.* v. *Michilin Prosperity Company, Ltd. and Intek America, Inc.,* Civil Action No. 2:06cv289, May 3, 2007, vol. 3, pp. 328–424.

Deposition transcript of Tai Matlin, *Fellowes, Inc.* v. *Michilin Prosperity Company, Ltd. and Intek America, Inc.,* Civil Action No. 2:06cv289, Apr. 3, 2007, pp. 1–33.

Deposition transcript of Bruce Kroger, *Fellowes, Inc.* v. *Michilin Prosperity Company, Ltd. and Intek America, Inc.,* Civil Action No. 2:06cv289, Apr. 15, 2007, pp. 1–217 pages.

Deposition Transcript of David Hartnett, *Fellowes, Inc.* v. *Michilin Prosperity Company, Ltd. and Intek America, Inc.,* Civil Action No. 2:06cv289, Apr. 18, 2007, pp. 1–318 pages.

Transcript of Trial Testimony of Lee Swanger, *Fellowes, Inc.* v. *Michilin Prosperity Company, Ltd. and Intek America, Inc.,* Civil Action No. 2:06cv289, May 8, 2007, vol. 6, pp. 799–901.

Transcript of 30(b)(6) Deposition Testimony of Tai Matlin, *Fellowes, Inc.* v. *Michilin Prosperity Company, Ltd. and Intek America, Inc.,* Civil Action No. 2:06cv289, May 8, 2007, vol. 9, pp. 1–293.

German Patent and Trademark Office, Request for Examination in '780 German Patent application, translation 3 pages, plus two cited references cited in Office Action, translations provided where available.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 14–16 is confirmed.

New claims 38–51 are added and determined to be patentable.

Claims 2–13 and 17–37 were not reexamined.

*38. A shredder according to claim 15, wherein:*

*the manually engageable portion of the on/off switch is mounted to slide linearly between the on and off positions thereof in a first direction,*

*the switch lock is mounted for movement between the locking and releasing positions thereof in a second direction perpendicular to the first direction,*

*in the locking position the switch lock engages an engageable structure beneath the top wall of the housing to lock the on/off switch in the off position,*

*in the releasing position the switch lock is disengaged from the engageable structure to release the on/off switch for movement from the off position,*

*the switch lock and the engageable structure comprise (a) a recess and (b) a member received in the recess in the locking position of the switch lock, and disengaged from the recess in the releasing position of the switch lock.*

*39. A shredder according to claim 1, wherein the on/off switch includes a switch module mounted within said housing, the manually engageable portion and the switch module of the on/off switch being connected directly together through an opening in an outer wall of the housing.*

*40. A shredder according to claim 1,*

*wherein the manually engageable portion of the on/off switch is mounted on an outer wall of the housing for movement between the on and off positions of the on/off switch.*

*41. A shredder according to claim 40, wherein the manually engageable portion of the on/off switch is mounted to slide between the on and off positions thereof in a first direction, and*

*wherein the switch lock is mounted for movement between the locking and releasing positions thereof in a second direction perpendicular to the first direction.*

*42. A shredder according to claim 1, wherein the manually engageable portion of the on/off switch is mounted on a top wall of the housing for linear movement between the on/off positions of the on/off switch.*

*43. A shredder according to claim 1, wherein the manually engageable portion of the switch lock is mounted for movement in a first direction between the locking and releasing positions.*

*44. A shredder according to claim 43, wherein the manually engageable portion of the on/off switch is mounted for movement in a second direction between the on and off positions of the on/off switch.*

*45. A shredder according to claim 44, wherein the first and second directions for the movements of the manually engageable portions are perpendicular to one another.*

*46. A shredder according to claim 45, wherein the manually engageable portion of the on/off switch is mounted on a top wall of the housing.*

*47. A shredder according to claim 1, wherein:*

*in the locking position the switch lock engages an engageable structure beneath the top wall of the housing to lock the on/off switch in the off position, and*

*in the releasing position the switch lock is disengaged from the engageable structure to release the on/off switch for movement from the off position.*

*48. A shredder according to claim 47, wherein the engageable structure is a part of the on/off switch.*

*49. A shredder according to claim 47, wherein the switch lock and the engageable structure comprise (a) a recess and (b) a member received in the recess in the locking position of the switch lock, and disengaged from the recess in the releasing position of the switch lock.*

*50. A shredder according to claim 1, wherein the switch lock includes no position in which it locks the switch in the on position.*

*51. A shredder according to claim 1, wherein, when in the on position, the manually engageable portion of the on/off switch naturally stays in the on position.*

* * * * *